US006556898B2

(12) United States Patent
Clawson

(10) Patent No.: US 6,556,898 B2
(45) Date of Patent: Apr. 29, 2003

(54) DISTRIBUTED TRACK NETWORK CONTROL SYSTEM

(75) Inventor: Keith W. Clawson, Monroeville, PA (US)

(73) Assignee: Bombardier Transportation GmbH (DE)

( * ) Notice: Subject to any disclaimer, the term of this patent is extended or adjusted under 35 U.S.C. 154(b) by 0 days.

(21) Appl. No.: 09/861,387

(22) Filed: May 18, 2001

(65) Prior Publication Data

US 2002/0173884 A1 Nov. 21, 2002

(51) Int. Cl.[7] ..... B61L 1/00; B61L 27/00

(52) U.S. Cl. ..... 701/19; 246/158; 246/162; 246/131; 246/176; 246/220; 104/130.01; 340/994

(58) Field of Search ..... 701/19; 246/5, 246/158, 176, 162, 220, 131, 120, 226, 233, 234, 239, 259; 307/413; 340/664, 991, 994; 342/457, 42; 104/130.01

(56) References Cited

U.S. PATENT DOCUMENTS

| | | | | | |
|---|---|---|---|---|---|
| 3,676,669 | A | | 7/1972 | Jauquet | 246/182 R |
| 3,794,977 | A | | 2/1974 | Thorne-Booth et al. | 340/163 R |
| 3,944,986 | A | * | 3/1976 | Staples | 340/172.5 |
| 3,976,272 | A | * | 8/1976 | Murray et al. | 246/2 R |
| 4,257,032 | A | | 3/1981 | Schneider | 340/171 A |
| 4,611,291 | A | * | 9/1986 | Hoelscher | 246/3 |
| 4,619,425 | A | | 10/1986 | Nagel | 246/34 R |
| 5,050,823 | A | | 9/1991 | Parker | 246/5 |
| 5,129,605 | A | * | 7/1992 | Burns et al. | 246/5 |
| 5,398,894 | A | * | 3/1995 | Pascoe | 246/28 |
| 5,533,695 | A | | 7/1996 | Heggestad et al. | 246/62 |
| 5,678,789 | A | * | 10/1997 | Pipich | 246/3 |
| 5,740,046 | A | * | 4/1998 | Elestedt | 342/457 |
| 5,950,966 | A | | 9/1999 | Hungate et al. | 246/62 |
| 6,032,905 | A | | 3/2000 | Haynie | 246/3 |
| 6,122,571 | A | * | 9/2000 | Gerstner et al. | 701/19 |

* cited by examiner

*Primary Examiner*—Thomas G. Black
*Assistant Examiner*—Tuan C To
(74) *Attorney, Agent, or Firm*—Webb Ziesenheim Logsdon Orkin & Hanson P.C.

(57) ABSTRACT

A distributed control system for a track network includes a local controller connected to a plurality of switch machines and a central office. The local controller receives from each switch machine a switch position signal and outputs to at least one switch machine a switch control signal related to a desired state of a track switch associated with the at least one switch machine in one of a plurality of positions. The local controller further outputs to the central office a first communication signal including switch position data corresponding to the switch position signal output by the at least one switch machine and receives from the central office, as a function of the first communication signal and a desired movement of one or more vehicles on the track network, a second communication signal which includes switch control data corresponding to the switch control data output to the at least one switch machine.

19 Claims, 7 Drawing Sheets

DISTRIBUTED TRACK NETWORK CONTROL SYSTEM

BACKGROUND OF THE INVENTION

1. Field of the Invention

The present invention relates to a system for monitoring and controlling one or more track networks to effect the safe and efficient movement of one or more railway vehicles on a plurality of track sections of the one or more track circuits.

2. Description of the Related Art

A prior art system for controlling the movement of one or more railway vehicles or trains on a track circuit typically includes a number of discreet elements distributed along the track circuit for sensing and controlling the position of track switches and for sensing and controlling the movement of trains. These sensing and control elements include, without limitation, switch machines coupled to track switches for monitoring and controlling the position thereof, vehicle presence detectors for detecting the presence of trains on sections of the track circuit and traffic lights. These sensing and control elements are well-known in the art and, therefore, will not be described in detail herein.

In a prior art system for controlling the movement of one or more trains on the track network, the sensing and control elements are connected to a central office which includes appropriate electrical and electronic computer controlled hardware operating under the control of a software program to acquire the output of the sensing elements; to process the output of the sensing elements as a function of a desired movement of one or more trains on the track network; and to control the control elements to effect the safe and efficient movement of the one or more trains on the track network.

A problem with the prior art systems for controlling the movement of one or more trains on a track network is that the central office is often located more than 1,000 feet away from the sensing and control elements associated with the track circuit. To this end, it has been observed that an average distance between the central office and the sensing and control elements is on the order of 1,500 feet. Because the central office is connected directly to each sensing and control element, a cable having a large number of wires, e.g., stranded and/or solid wires, must be connected between the central office and the sensing and control elements. Moreover, this cable must include wires of different gauges for conveying sensing signals, which can be conveyed over a smaller diameter wire, and for conveying control or energizing signals, which must be conveyed over larger diameter wires. Because of the possible number of wires included in a cable and the length of the cable, these cables can be expensive to prepare and install. In addition, because of the wide variations of sensing and control elements that may be needed for different track circuits, it is not practical or cost effective to build cables having a standard number of wires and/or a standard length in a manufacturing environment, where such cables could, if standardized, be manufactured both practically and cost effectively.

It is, therefore, an object of the present invention to overcome the above problems and others by providing a distributed control system for monitoring and controlling the sensing elements and controlling control elements associated with a track network. Still other objects will become apparent to those of ordinary skill in the art upon reading and understanding the following detailed description.

SUMMARY OF THE INVENTION

Accordingly, I have invented a system for controlling the movement of one or more vehicles or trains on a track network. The system includes a plurality of switch machines, with each switch machine outputting a switch position signal indicative of the state of a track switch associated with the switch machine in one of a plurality of positions, and receiving a switch control signal related to a desired state of the track switch in one of the plurality of positions. A local controller is connected to receive from each switch machine its switch position signal and to output a first communication signal including switch position data corresponding to the switch position signal output by at least one switch machine. The local controller also receives a second communication signal including switch control data corresponding to a desired state of at least one track switch, and outputs to the switch machine associated with the at least one track switch, as a function of the switch control data, the switch control signal. Lastly, a central office is connected to receive the first communication signal and to output the second communication signal as a function of the first communication signal and the desired movement of one or more vehicles on the track network.

At least one traffic light can be connected to the local controller. The traffic light can have a plurality of states, and the second communication signal can also include traffic light control data corresponding to a desired state of the traffic light. The local controller can output to the traffic light, as a function of the traffic light control data, a traffic light control signal related to the desired state of the traffic light.

At least one vehicle presence detector can be connected to the local controller. The vehicle presence detector can output to the local controller a vehicle presence signal corresponding to the presence of a vehicle on the track network. The first communication signal can include vehicle presence data corresponding to the vehicle presence signal output by the vehicle presence detector.

Preferably, at least one of the first communication signal and the second communication signal is a network protocol communication signal. The local controller is preferably positioned closer to the plurality of switch machines than the central office.

The local controller can include a first programmable controller and a second programmable controller connected for at least one of (i) operation redundant mode of operation where each of the first and second programmable controller compares the switch position signal from each switch machine, outputs the first communication signal, receives the second communication signal, and compares the switch control data; and (ii) a fail-safe redundant mode of operation where the first and second programmable controllers coact to output the switch control signal which comprises a pair of voltages which cause the switch machine to switch the track circuit to a desired state.

I have also invented a distributed control system for a track network. The distributed control system includes a local controller connected to a plurality of switch machines and a central office. Each switch machine is configured to monitor and control the state of at least one track switch associated therewith. The central office is configured to control the movement of vehicles on the track network. The local controller is configured to receive from each switch machine a switch position signal and to output to at least one switch machine a switch control signal related to a desired state of the track switch associated with at least one switch machine in one of a plurality of positions. The local controller is further configured to output to the central office a first communication signal including switch position data corresponding to the switch position signal output by the at least one switch machine and to receive from the central office as a function of the first communication signal and a desired movement of one or more vehicles on the track network a second communication signal which includes switch control data corresponding to the switch control signal output to the at least one switch machine.

Preferably, at least one vehicle presence detector is connected to the local controller. The vehicle presence detector is configured to output to the local controller a vehicle presence signal related to the presence of a vehicle on the track network. The first communication signal can include vehicle presence data related to the vehicle presence signal output by the vehicle presence detector. At least one traffic light can also be connected to the local controller. The local controller can control the traffic light to be in one of a plurality of states in response to the traffic light receiving from the local controller a traffic light control signal related to the one state. The second communication signal can include traffic light control data corresponding to a desired state of the traffic light and the local controller can output to the traffic light, as a function of the traffic light control data, the traffic light control signal. The plurality of optical states of the traffic light can include an on-state and an offstate of one lamp.

Each switch machine is connected to the local controller by a first cable, and the central office is connected to the local controller by a second cable. The maximum length of the first cable is less than the maximum length of the second cable.

I have also invented a method of controlling vehicles on a track network. The method includes providing a track network having a plurality of switch machines connected to a local controller. The local controller receives from each of the switch machines a switch position signal related to a state of a track switch associated with the corresponding switch machine. At least one switch position signal received by the local controller is converted into switch position data which is transmitted from the local controller to a central office. Switch control data is received by the local controller from the central office as a function of the switch position data transmitted to the central office and a desired movement of vehicles on the track network. The switch control data received at the local controller is converted into a switch control signal which is conveyed from the local controller to the at least one switch machine which sets the corresponding track switch to a state related to the switch control signal.

The local controller can also receive from a vehicle presence detector a vehicle presence signal related to the presence of a vehicle on the track network. The vehicle presence signal received by the local controller can be converted into vehicle presence data which can be transmitted from the local controller to the central office. The switch control data received at the local controller from the central office can also be a function of the vehicle presence data.

Traffic light control data can also be received at the local controller from the central office as a function of the switch position data and a desired movement of vehicles on the track network. The traffic light control data corresponds to a desired state of a traffic light connected to the local controller. The traffic light control data received by the local controller can be converted into a traffic light control signal which is transmitted from the local controller to the traffic light whereby the traffic light is set in one of a plurality of optical states.

Lastly, I have invented an apparatus for controlling vehicles on a track network. The apparatus includes a central office configured to control the movement of vehicles on the track network and a plurality of switch machines. Each switch machine is configured to output a switch position signal indicative of a state of a track switch associated with the switch machine in one of a plurality of positions and to control the state of the track switch in response to receiving a switch control signal. A local controller is configured for receiving from the plurality of switch machines the switch position signals related to the state of the track switches controlled by the plurality of switch machines. The local controller converts the switch position signals into switch position data and transmits the switch position data to the central office. The local controller receives switch control data from the central office as a function of the transmitted switch position data and a desired movement of vehicles on the track network. The local controller converts the received switch control data into switch control signals and conveys each switch control signal to one of the switch machines whereby the corresponding track switch is set to a state related to the switch control signal received by the one of the switch machines.

A traffic light can be connected to the local controller and the local controller can receive traffic light control data from the central office as a function of the switch position data and a desired movement of vehicles on the track network. The local controller converts the received traffic light control data into a traffic light control signal and transmits the traffic light control signal to the traffic light whereby the traffic light is set in one of a plurality of optical states as a function of the traffic light control signal.

Lastly, a vehicle presence detector can be configured to output to the local controller a vehicle presence signal as a function of the presence of a vehicle on the track network. The local controller converts the received vehicle presence signal into vehicle presence data and transmits the vehicle presence data to the central office. The switch control data received by the local controller can also be a function of the transmitted vehicle presence data.

DETAILED DESCRIPTION OF THE PREFERRED EMBODIMENTS

Figure 1A:
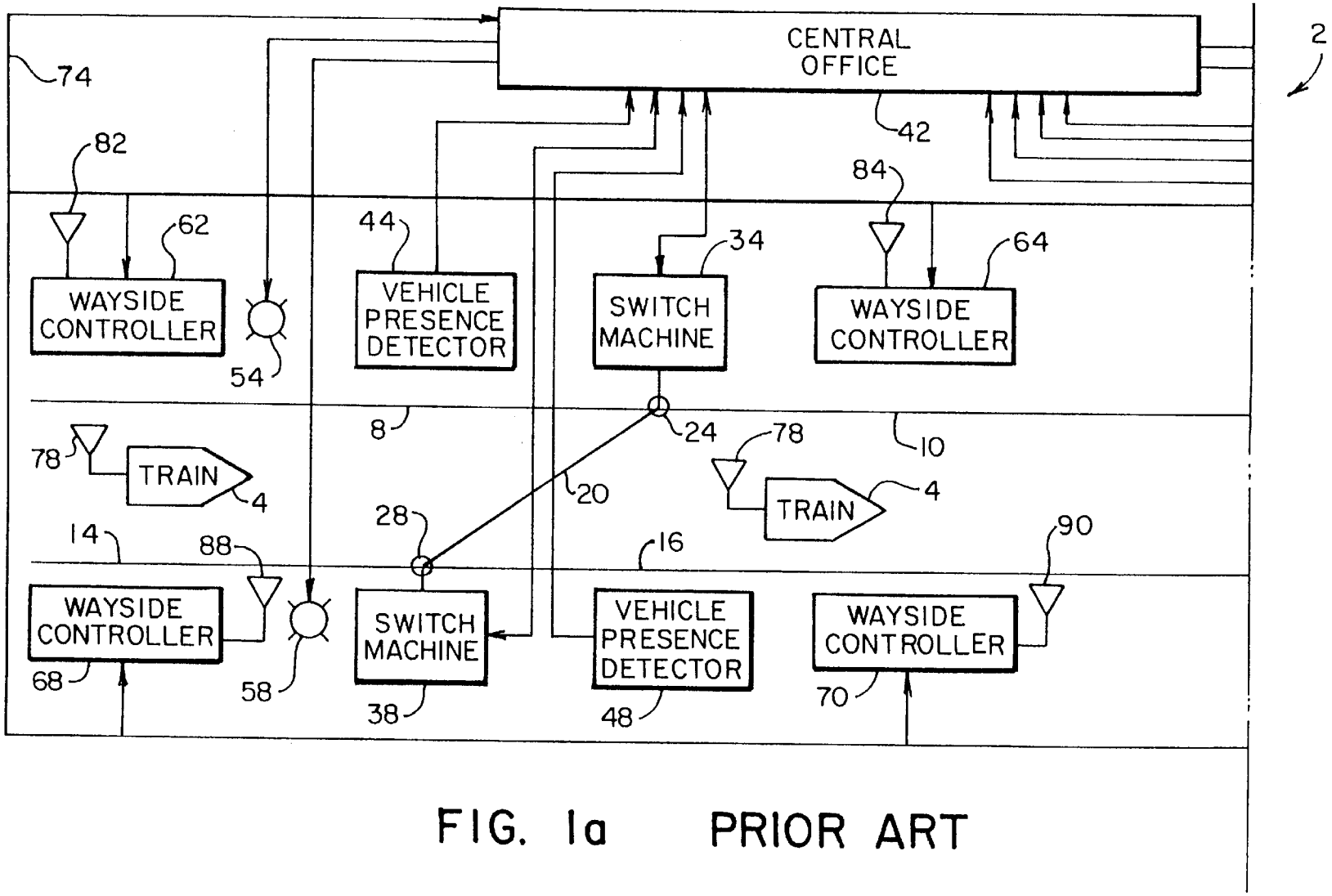
FIG. 1a PRIOR ART
FIGS. 1*a*–1*b* are a block diagram of a track circuit control system in accordance with the prior art.
Figure 1B:
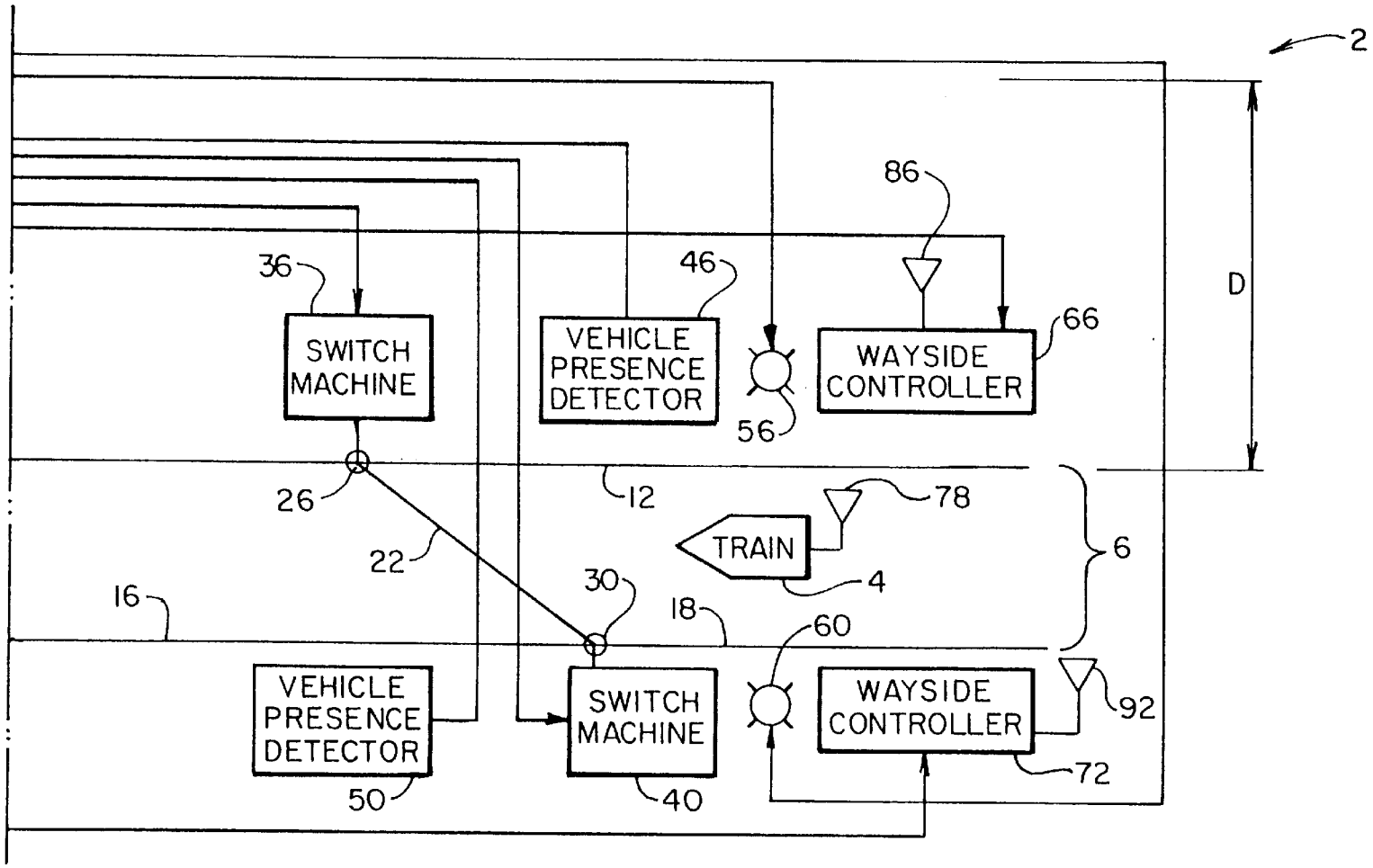
FIG. 1b PRIOR ART

With reference to FIGS. 1*a* and 1*b*, a system 2 for controlling the movement of one or more vehicles or trains 4 on a track circuit 6 is shown. Track circuit 6 includes track sections 8–18 and crossover track sections 20 and 22. The intersections of track sections 8, 10 and 20; 10, 12 and 22; 14, 16 and 20; and 16, 18 and 22 include track switches 24, 26 28 and 30, respectively. Switch machines 34, 36, 38 and 40 are coupled to track switches 24, 26, 28 and 30, respectively, for monitoring the state thereof in one of a plurality of positions. Each switch machine 34, 36, 38 and 40 also controls the state of track-switches 24, 26, 28 and 30, respectively, in response to receiving a switch control signal from a central office 42.

Each switch machine 34–40 is connected directly to central office 42. Each switch machine 34–40 supplies to central office 42 a switch position signal indicative of the state of the track switch 24–30 coupled to each switch machine 34–40. In addition, each switch machine 34–40 can receive from central office 42 a switch control signal which causes the switch machine to set the corresponding track switch to a state related to the switch control signal received by the switch machine. More specifically, the switch control signal supplied by central office 42 to a switch machine, e.g., switch machine 34, is the actual signal which causes the switch machine to switch the corresponding track switch, e.g., track switch 24, to a state related to the switch control signal. Stated differently, each switch control signal is the actual energizing signal which causes the switch machine to set its corresponding track switch to a state related to the switch control signal.

System 2 also includes vehicle presence detectors 44, 46, 48 and 50 positioned for detecting the presence of train or vehicle 4 on one or more of the track sections. Vehicle presence detectors 44–50 are each connected to provide central office 42 with a vehicle presence signal corresponding to the presence of vehicle 4 on the one or more track sections monitored thereby. The vehicle presence signal output by each vehicle presence detector 44–50 must be of a sufficient voltage so that central office 42 can detect it after the vehicle presence signal propagates on the wires or cables connected therebetween.

System 2 also includes traffic lights 54, 56, 58 and 60. Each traffic light 54–60 is connected to receive from central office 42 a traffic light control signal. Each traffic light control signal output by central office 42 is an energizing signal which causes a traffic light to assume a desired optical state. More specifically, each traffic light control signal output by central office 42 is an energizing signal utilized to energize a lamp of a traffic light. For example, if traffic light 54 has separate lamps for a red light and a green light, central office 42 supplies one traffic light control signal to the lamp related to the green light and provides another traffic light control signal to the lamp related to the red light.

Lastly, system 2 includes wayside controllers 62, 64, 66, 68, 70 and 72 positioned adjacent track circuit 6 and communicatively connected to central office 42 via a communication cable 74, such as a fiber optic cable, an electrically conductive cable, or combinations thereof.

Each wayside controller 62–72 includes a radio transceiver 82–92, respectively, and each train 4 includes a radio transceiver 78. Each wayside controller 62–72 facilitates communication between central office 42 and one or more trains 4 traveling on track sections 8–18, via radio transceivers 82–92, respectively, and radio transceivers 78 associated with each train 4. For example, central office 42 and train 4 traveling on track section 8 are in communication via radio transceiver 78 of said train and radio transceiver 82 of wayside controller 62. Each crossover track section 20 and 22 can have one of the wayside controllers 62–72 facilitate communication with train 4 traveling thereon.

Central office 42 includes software-controlled computer hardware (not shown) which coacts with switch machines 34–40, vehicle presence detectors 44–50, traffic lights 54–60, and wayside controllers 62–72 to effect the safe and effective movement of one or more trains 4 on track circuit 6 in a manner known in the art.

A problem with system 2 is that central office 42 is routinely positioned more than 1,000 feet away from track circuit 6. Since central office 42 is directly connected to each of switch machines 34–40, vehicle presence detectors 44–50, and traffic lights 54–60, all of which are positioned adjacent track circuit 6 a distance D from central office 42, a significant number and length of wiring or cabling is required between central office 42 and switch machines 34–40, vehicle presence detectors 44–50, and traffic lights 54–60. In addition, because of this distance D, central office 42 must output to each switch machine 34–40 and to each traffic light 54–60 a switch control signal and a traffic light control signal, respectively, having a voltage and current sufficient to energize each switch machine 34–40 to set the corresponding track switch 24–30 in a desired position and to cause the lamp associated with each traffic light 54 to illuminate to a desired extent, respectively, while accounting for the power losses associated with transmitting these signals on their corresponding wires or cables over distance D. Similarly, the voltage and current associated with the switch position signal and the vehicle presence signal output by each switch machine and vehicle presence detector, respectively, must be of a sufficient level that central office 42 can detect these signals after traveling along their respective wires or cables distance D.

Figure 2A:
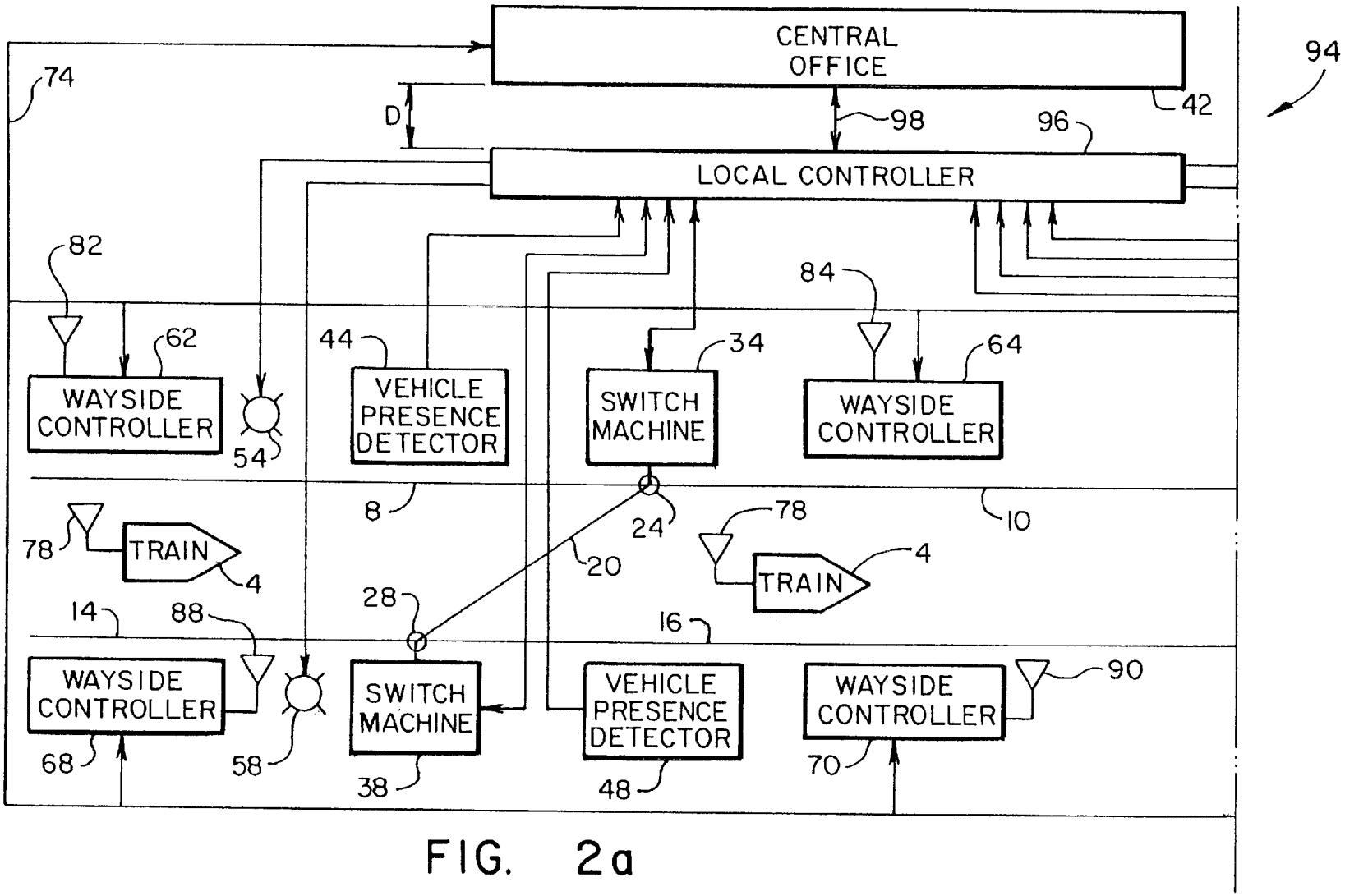
FIGS. 2*a*–2*b* are a block diagram of a track control system in accordance with one embodiment of the present invention.
Figure 2B:
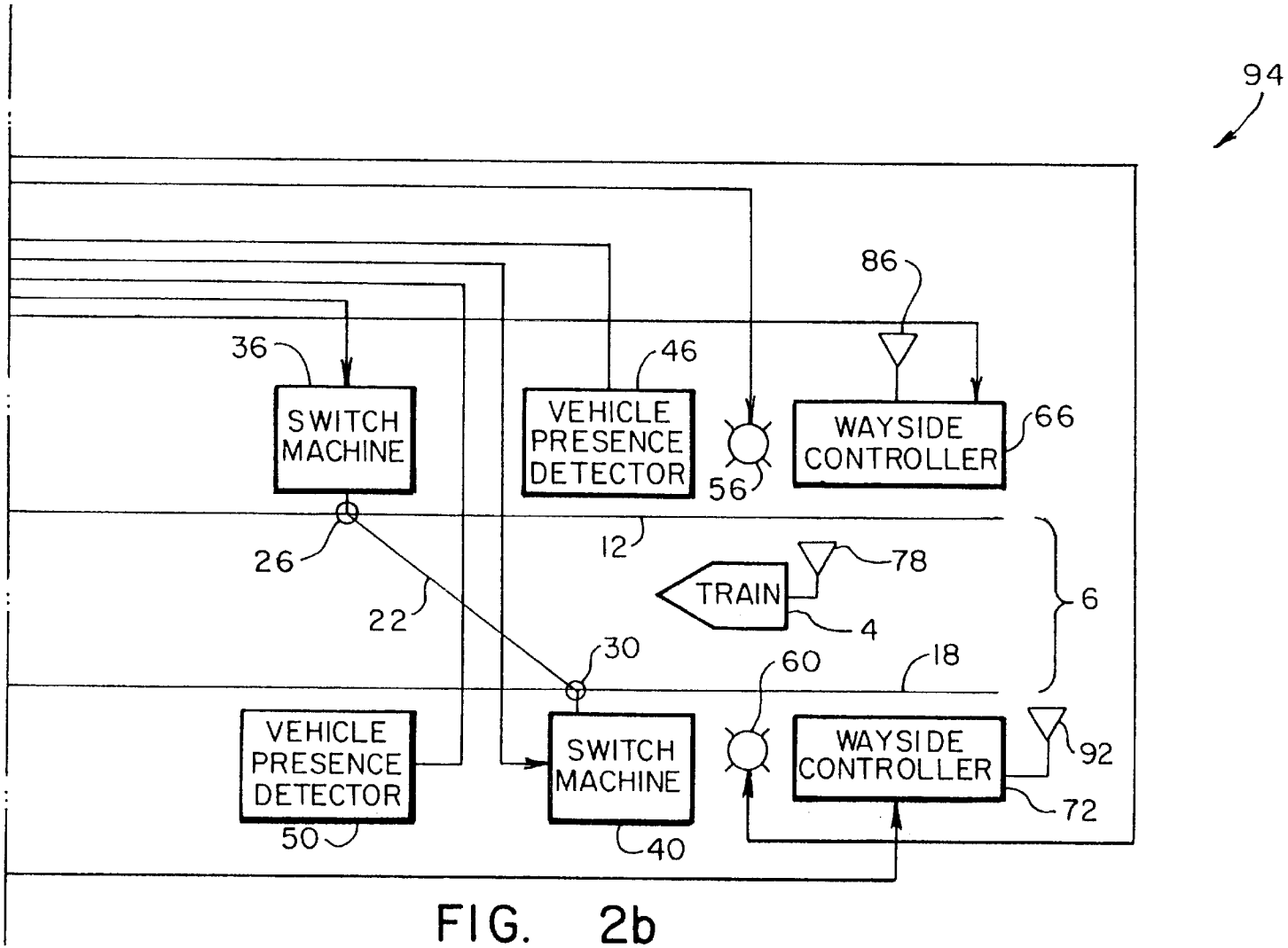

With reference to FIGS. 2*a*–2*b*, a system 94 in accordance with the present invention for controlling the movement of one or more trains 4 on track circuit 6 includes track switches 24–30, switch machines 34–40, vehicle presence detectors 44–50, and traffic lights 54–60 connected to a local controller 96. Local controller 96 is connected in the same manner as central office 42 in FIG. 1 to switch machine 34–40, vehicle presence detectors 44–50, and traffic lights 54–60. However, local controller 96 is connected to central office 42 by a communication cable 98, such as a fiber optic cable, an electrically conductive cable or a combination of both. Preferably, local controller 96 is positioned adjacent track circuit 6, and communication cable 98 extends a majority of distance D that heretofore the wires or cables connected to local controller 96 extended. Thus, the maximum length of each wire or cable connected between local controller 96 and switch machines 34–40, vehicle presence detectors 44–50, and traffic lights 54–60 is less than, e.g., $\leqq 10\%$, the length of communication cable 98 connected between local controller 96 and central office 42. Central office 42 and local controller 96 are preferably configured to implement a desired network protocol, such as Ethernet, which utilizes communication cable 98 to effect transmission of network protocol signals communication from central office 42 to local controller 96, and vice versa.

Figure 3:
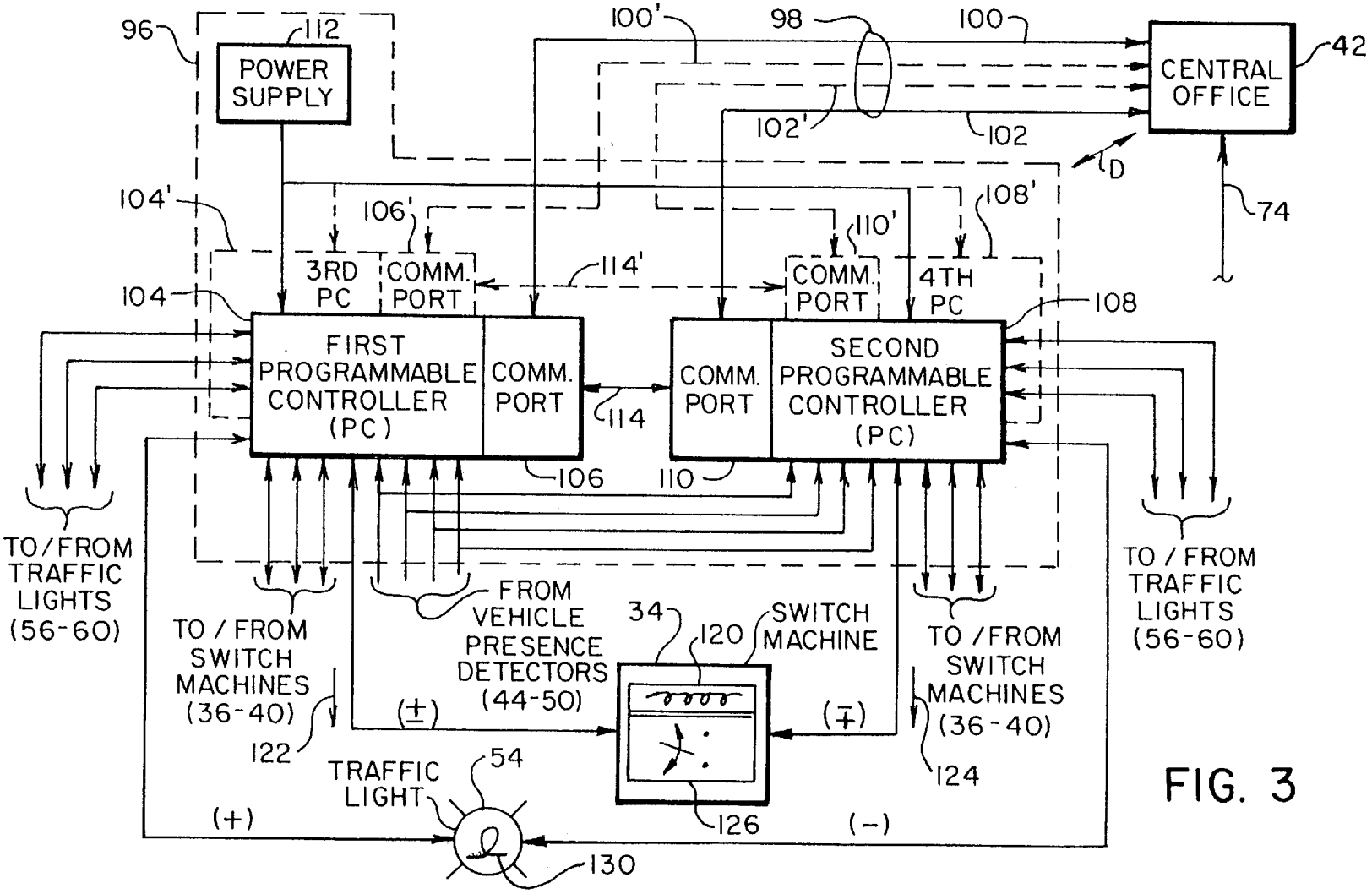
FIG. 3 is a block diagram of the internal components of the local controller in FIG. 2 connected in an operation redundant mode operation and/or a fail-safe redundant mode of operation.

With reference to FIG. 3, and with continuing reference to FIGS. 2*a* and 2*b* communication cable 98 preferably includes a first communication line 100 and a second communication line 102 connected between local controller 96 and central office 42. Local controller 96 includes a first programmable controller 104 having a communication port 106 connected to the end of first communication line 100 opposite central office 42. Local controller 96 also includes a second programmable controller 108 having a communication port 110 connected to an end of second communication line 102 opposite central office 42. A power supply 112 is connected to receive incoming electrical power from an external source of electrical power (not shown) and to convert the incoming electrical power to one or more voltages usable by programmable controllers 104 and 108, switch machines 34–40, and traffic lights 54–60.

Preferably, programmable controllers 104 and 108 are connected in a fail-safe redundant mode of operation with programmable controller 108 and programmable controller 104 communicating with each other via a communication line 114 extending between communication port 110 and communication port 106, respectively. In the fail-safe redundant mode of operation, all communications between programmable controller 96 and central office 42 occur in a redundant manner. For example, in response to receiving a switch position signal from each switch machine 34–40, programmable controller 104 converts each switch position signal received thereby into switch position data which is supplied to the other programmable controller 108 via communication line 114. Similarly, programmable controller 108 converts each switch position signal received thereby into switch position data which programmable controller 108 supplies to programmable controller 104 via communication line 114. Programmable controller 104 compares its switch position data with the switch position data received from programmable controller 108. Similarly, programmable controller 108 compares its switch position data with the switch position data received from programmable controller 104. If either programmable controller 104 or 108 determines that its switch position data does not match the switch position data received from the other programmable controller, the programmable controller 104 or 108 detecting the difference modulates fault data onto a first communication signal which is transmitted to central office 42 which takes appropriate action known in the art in response to receiving the fault data. However, if each programmable controller 104 and 108 determines that its switch position data matches the switch position data received from the other programmable controller, each programmable controller modulates that received switch position data onto a corresponding first communication signal. Programmable controller 104 then transmits its first communication signal to central office 42 via first communication line 100, and programmable controller 108 transmits its first communication signal to central office 42 via second communication line 102.

In a similar manner, programmable controllers 104 and 108 each receive a vehicle presence signal output by each vehicle presence detector 44–50, convert the received vehicle presence signal into vehicle presence data, compare its vehicle presence data with the vehicle presence data received from the other programmable controller and, in the event of a match between its vehicle presence data and the vehicle presence data received from the other programmable controller, modulate the vehicle presence data onto the first communication signal which is transmitted to central office 42 via first communication line 100 and second communication line 102, respectively.

Central office 42 demodulates and compares the switch control data and/or the vehicle presence data received on the first communication signal received on first communication line 100 and the first communication signal received on second communication line 102. In the event of a match between the switch control data and/or the vehicle presence data received on the first communication signal and the switch control data and/or the vehicle presence data received on the second communication signal, central office 42 processes the switch control data and/or the vehicle presence data along with data received from one or more trains 4 on track section 6 received via communication cable 74 in a manner known in the art.

Thereafter, as required to control the travel of trains 4 on track circuit 6, central office 42 modulates switch control data and/or traffic light control data onto a second communication signal and supplies the second communication signal to first programmable controller 104 and second programmable controller 108 via first communication line 100 and second communication line 102, respectively. First and second programmable controllers 104 and 108 each demodulate the switch control data and/or the traffic light control data from the second communication signal received thereby and provide this data to the other programmable controller via communication line 114. Thereafter, each programmable controller 104 and 108 compares its switch control data and/or the traffic light control data with the switch control data and/or the traffic light control data received from the other programmable controller. In response to each programmable controller 104 and 108 determining that its switch control data and/or the traffic light control data matches the switch control data and/or the traffic light control data received from the other programmable controller, each programmable controller 104 and 108 outputs part of a switch control signal to the appropriate switch control machine and/or outputs part of a traffic light control signal to the appropriate traffic light. To ensure each switch machine and each traffic light receives the switch control signal and the traffic light control signal, respectively, intended therefor, each switch machine and each traffic light are assigned a unique data address which is included as part of the switch control data and/or the traffic light control data modulated on the second communication signals output by central office 42 on first communication line 100 and second communication line 102. Thus, the switch control data and/or the traffic light control data demodulated from the second communication signals received by first programmable controller 104 and second programmable controller 108 not only include data regarding a desired state of a track switch controlled by one of the switch machines and/or the state of the lamps of one of the traffic lights, but also include the address of the switch machine and/or traffic light to receive the switch position signal and/or the traffic light control signal corresponding to the switch position data and/or the traffic light control data.

In fail-safe redundant mode of operation, first programmable controller 104 is connected to supply to each switch machine 34–40 and each traffic light 54–60 a source of electrical power or ground, and second programmable controller 108 is configured to supply each switch machine 34–40 and each traffic light 54–60 the other of the source of electrical power or ground. Thus, it is necessary for first programmable controller 104 and second programmable controller 108 to cooperate in order to cause a switch machine to set a track switch in a desired position and to cause a traffic light to illuminate a desired lamp. For example, suppose that switch machine 34 includes an energizing coil 120 which causes track switch 24 to set to a first position in response to current flowing through energizing coil 120 in a first direction 122, and which causes track switch 24 to set to a second position in response to no electrical current flowing through energizing coil 120. In response to first programmable controller 104 and second programmable controller 108 receiving from central office 42 switch position data corresponding to track switch 24 being set in a first position, first programmable controller 104 and second programmable controller 108 coact to supply to energizing coil 120 a switch position signal which causes current to flow through energizing coil 120 in first direction 122. Similarly, in response to first programmable controller 104 and second programmable controller 108 receiving from central office 42 switch position data corresponding to track switch 24 being set in its second position, first programmable controller 104 and second programmable controller 108 coact to supply to de-energize coil 120 a track position signal which causes no current to flow through energizing coil 120. Thus, by controlling the current flow through energizing coil 120, first programmable controller 104 and second programmable controller 108 coact to set track switch 24 in its first position or in its second position.

Each switch machine 34–40 can also include a switch position indicator 126 connected to detect the position of its corresponding track switch 24–30 and to provide to first programmable controller 104 and second programmable controller 108 a switch position signal indicative thereof.

It is to be appreciated that while first programmable controller 104 and second programmable controller 108 are each shown as being connected to one side of switch machine 34 by a single line, each of these lines represents one or more wires of a cable with one terminal of switch position indicator 126 and one terminal of energizing coil 120 connected by separate wires to an input and an output, respectively, of first programmable controller 104, and with the other terminal of switch position indicator 126 and the other terminal of energizing coil 120 connected by separate wires to an input and an output, respectively, of second programmable controller 108.

In a manner similar to switch machines 34–40, first programmable controller 104 and second programmable controller 108 coact to illuminate lamps of traffic lights 54–60. For example, suppose that traffic light 54 includes a lamp 130 having one terminal connected to an output of first programmable controller 104 and another terminal connected to an output of second programmable controller 108. In response to first programmable controller 104 and second programmable controller 108 receiving from central office 42 traffic light control data related to an on-state or off-state of lamp 130 of traffic light 54, first programmable controller 104 and second programmable controller 108 coact to supply to lamp 130 a traffic light control signal which controls the illumination of lamp 130. Preferably, the lamp control signal supplied to lamp 130 has two states, namely, an off-state where the lamp control signal applies little or no voltage across lamp 130, whereby lamp 130 is not illuminated, and an on-state where the lamp control signal applies to a lamp 130 a voltage sufficient to cause lamp 130 to illuminate to an extent to be viewed by operators of trains 4 traveling on track circuit 6.

Communication cable 98 can also include a third communication line 100' and a fourth communication line 102' connected between a local controller 96 and central office 42. Moreover, local controller 96 can include a third programmable controller 104' (shown in phantom) having a communication port 106' connected to an end of communication line 100' opposite central office 42. Local controller 96 can also include a fourth programmable controller 108' (shown in phantom) having a communication port 110' connected to an end of fourth communication line 102' opposite central office 42. Power supply 112 is connected to supply one or more voltages to programmable controllers 104' and 108'. Preferably, programmable controllers 104' and 108' are connected in a fail-safe redundant mode of operation with programmable controller 108' and programmable controller 104' communicating with each other via a communication line 114' extending between communication port 110' and communication port 106'. Third programmable controller 104' and fourth programmable controller 108' are connected to switch machines 36–40, vehicle presence detectors 44–50 and traffic lights 56–60 in the same manner as first programmable controller 104' and second programmable controller 108', respectively. For simplicity of illustration, these later connections between third and fourth programmable controllers 104' and 108' and switch machines 36–40, vehicle presence detectors 44–50 and traffic lights 56–60 have not been included in FIGS. 3*a* and 3*b*.

In addition, programmable controllers 104' and 108' are configured to implement an operation redundant mode of operation. In the operation redundant mode of operation, central office 42 controls which pair of programmable controllers are actively implementing the fail-safe redundant mode of operation and which pair of programmable controllers are idle. For example, central controller 42 can control programmable controllers 104 and 108 to be active implementing the fail-safe redundant mode of operation, while at the same time central office 42 can cause programmable controllers 104' and 108' to be idle. At a suitable time, central office 42 can cause programmable controllers 104 and 108 to switch from an active state to an idle state, while causing programmable controllers 104' and 108' to switch from an idle state to an active state implementing the fail-safe redundant mode of operation. By including programmable controllers 104' and 108' connected in an operation redundant mode of operation with programmable controllers 104 and 108, local controller 96 can continue to process switch position signals from each switch machine 34–40 and the vehicle presence signals from each vehicle presence detector 44–50, and can control the states of switch machines 36–40 and traffic lights 56–60 under the control of central office 42, even in the event one of the programmable controllers 104, 104', 108 and 108' of local controller 96 is not operating.

As can be seen, the use of local controller 96 positioned adjacent track circuit 6 avoids the need to run numerous and lengthy wiring or cabling from central office 42 to switch machines 34–40, vehicle presence detectors 44–50, and traffic lights 54–60. It is believed that this reduction in wiring or cabling will result in a reduced cost of installation and maintenance of system 94 versus system 2, while providing equivalent or better performance. Moreover, since the functions of sensing the switch position signals and the vehicle presence signals and supplying switch control signals and traffic light control signals have been moved from central office 42 in system 2 to local controller 96 in system 94, the complexity of central office 42 can be decreased. Moreover, on system 94, because the monitoring of switch position signals and vehicle presence signals, as well as the supplying of switch control data and traffic light control data, resides in local controller 96, central office 42 can be utilized to control more than one track section or larger track sections simply by connecting additional local controllers between central office 42 and the switch machines, vehicle presence detectors, and/or traffic lights of these other or expanded track circuits.

Figure 4A:
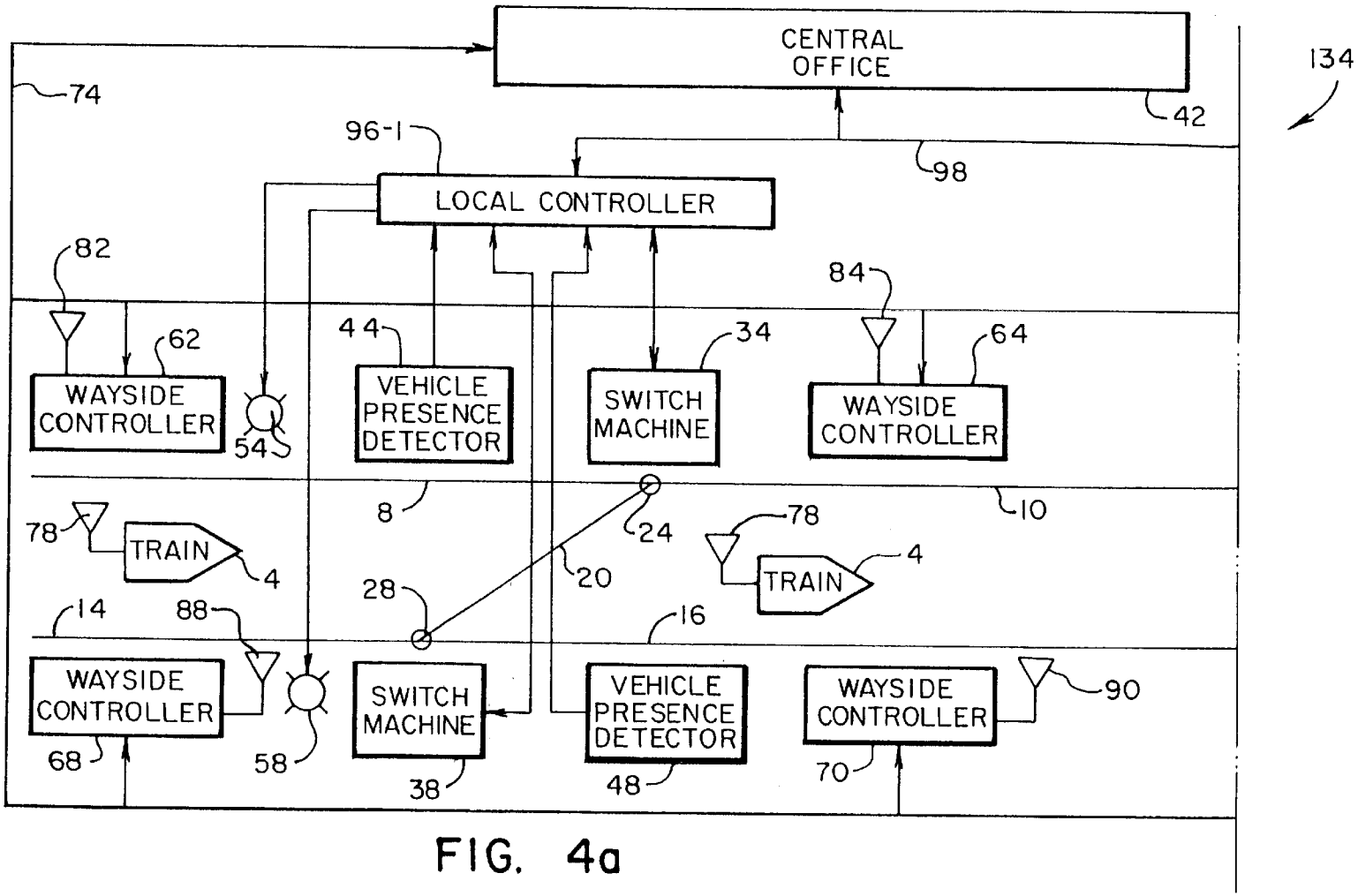
FIGS. 4*a*–4*b* are a block diagram of a track circuit control system in accordance with another embodiment of the present invention.
Figure 4B:
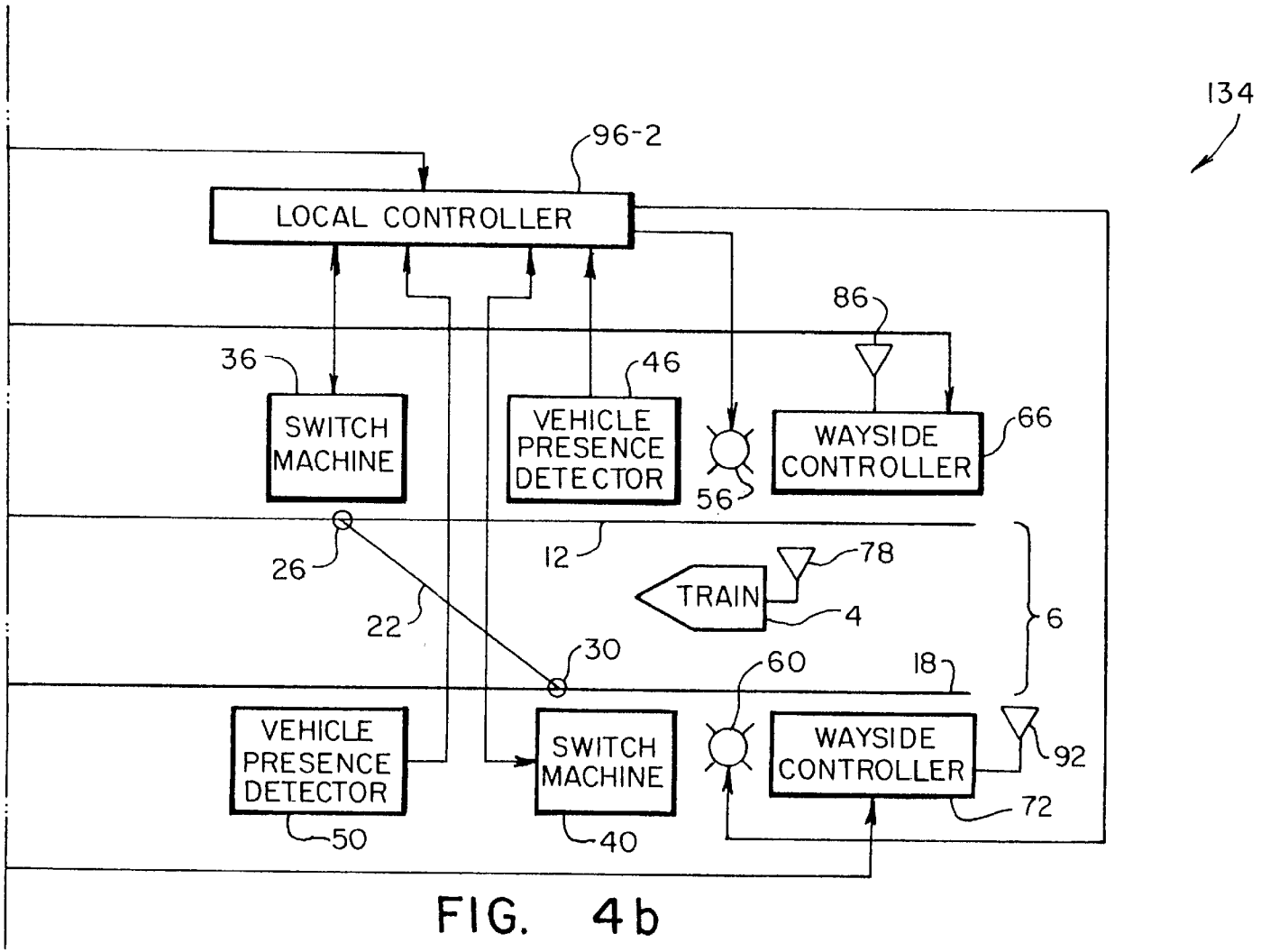

With reference to FIGS. 4*a* and 4*b* and with continuing reference to FIGS. 2*a* and 2*b* another system 134 in accordance with the present invention includes track circuit 6, track switches 24–30, switch machines 34–40, vehicle presence detectors 44–50, traffic lights 54–60, wayside controllers 62–72, and central office 42 as described above in connection with FIGS. 2*a* and 2*b* System 134, however, includes a pair of local controllers 96-2 each similar to local controller 96.

Local controller 96-1 is connected to receive switch position signals from switch machines 34 and 38, and vehicle presence signals from vehicle presence detectors 44 and 48. In addition, local controller 96-1 is also connected to provide switch control signals to switch machines 34 and 38, and to provide traffic light control signals to traffic lights 54 and 58.

Local controller 96-2 is connected to receive switch position signals from switch machines 36 and 40, and to receive vehicle presence signals from vehicle presence detectors 46 and 50. In addition, local controller 96-2 is connected to provide switch control signals to switch machines 36 and 40, and to provide traffic light control signals to traffic lights 56 and 60.

Local controllers 96-1 and 96-2 are connected to central office 42 by communication cable 98. Central office 42 and local controllers 96-1 and 96-2 are preferably configured to implement a desired network protocol, such as Ethernet, which utilizes communication cable 98 to effect transmission of network protocal communication signals from central office 42 to local controllers 96-1 and 96-2, and vice versa. Alternatively, each local controller 96-1 and 96-2 can be connected to central office 42 by a dedicated communication cable (not shown).

In system 134, each local controller 96-1 and 96-2 can output a first communication signal including switch position data corresponding to received switch position signals, and/or vehicle presence data corresponding to received vehicle presence signals. In addition, each local controller 96-1 and 96-2 can receive from central office 42 a second communication signal which includes switch control data and/or traffic light control data which are converted into one or more switch control signals and/or one or more traffic control signals to be selectively output to the switch machines and traffic lights connected to respective local controllers 96-1 and 96-2.

System 134 illustrates that a plurality of local controllers, e.g., 96-1 and 96-2, can be utilized to control the movement of trains 4 on track circuit 6. Local controllers 96-1 and 96-2 can also be connected to other switch machines, vehicle presence detectors and/or traffic lights within their design capability in order to expand the capability of system 134 to control the movement of trains 4 on more track sections or to enlarge the coverage area of track circuit 6.

The invention has been described with reference to the preferred embodiments. Obvious modifications and alterations will occur to others upon reading and understanding the preceding detailed description. For example, while each local controller 96, 96-1 and 96-2 is described as having programmable controllers 104, 108 and 104', 108' connected in operation redundant mode of operation, one or more of local controllers 96, 96-1 and 96-2 can include a pair of programmable controllers connected in the operation redundant mode of operation, but not in the fail-safe redundant mode of operation. In addition, local controllers 96, 96-1 or 96-2 can include a single programmable controller configured to perform the functions of programmable controllers 104 and 108 discussed above, but without the operation redundant mode of operation or the fail-safe redundant mode of operation. It is intended that the invention be construed as including all such modifications and alterations insofar as they come within the scope of the appended claims or the equivalents thereof.

I claim:

1. A system for controlling the movement of one or more vehicles on a track network, the system comprising:

a plurality of switch machines, each switch machine outputting a switch position signal indicative of a state of a track switch associated with the switch machine in one of a plurality of positions and receiving a switch control signal related to a desired state of the track switch in one of the plurality of positions;

a local controller connected to receive from each switch machine its switch position signal, to output a first communication signal including switch position data corresponding to the switch position signal output by at least one switch machine, to receive a second communication signal including switch control data corresponding to a desired state of at least one track switch, and to output to the switch machine associated with the at least one track switch as a function of the switch control data the switch control signal; and a central office connected to receive the first communication signal and to output the second communication signal as a function of the first communication signal and a desired movement of one or more vehicles on the track network.

2. The system as set forth in claim 1, further including at least one traffic light connected to the local controller, the traffic light having a plurality of states, wherein:

the second communication signal also includes traffic light control data corresponding to a desired state of the traffic light; and the local controller outputs to the traffic light as a function of the traffic light control data a traffic light control signal related to the desired state of the traffic light.

3. The system as set forth in claim 1, further including at least one vehicle presence detector connected to the local controller, the vehicle presence detector outputting to the local controller a vehicle presence signal corresponding to the presence of a vehicle on the track network, the first communication signal including vehicle presence data corresponding to the vehicle presence signal output by the vehicle presence detector.

4. The system as set forth in claim 1, wherein at least one of the first communication signal and the second communication signal is a network protocol communication signal.

5. The system as set forth in claim 1, wherein the local controller is positioned closer to the plurality of switch machines than the central office.

6. The system as set forth in claim 1, wherein:

the local controller includes a first programmable controller and a second programmable controller for at least one of (i) an operation redundant mode of operation where each of the first and second programmable controllers compares the switch position signal from each switch machine, outputs the first communication signal, receives the second communication signal, and compares the switch control data; and (ii) a fail-safe redundant mode of operation where the first and second programmable controllers coact to output; and the switch control signal which comprises a pair of voltages which cause the switch machine to switch the track switch to a desired state.

7. A distributed control system for a track network, the distributed control system comprising a local controller connected to a plurality of switch machines and a central office, each switch machine configured to monitor and control the state of at least one track switch associated therewith, the central office configured to control the movement of vehicles on the track network, the local controller configured to receive from each switch machine a switch position signal and to output to at least one switch machine a switch control signal related to a desired state of the track switch associated with at least one switch machine in one of a plurality of positions, the local controller further configured to output to the central office a first communication signal including switch position data corresponding to the switch position signal output by the at least one switch machine and to receive from the central office as a function of the first communication signal and a desired movement of one or more vehicles on the track network a second communication signal which includes switch control data corresponding to the switch control signal output to the at least one switch machine.

8. The distributed control system as set forth in claim 7, further including at least one vehicle presence detector connected to the local controller, the vehicle presence detector configured to output to the local controller a vehicle presence signal related to the presence of a vehicle on the track network, wherein the first communication signal includes vehicle presence data related to the vehicle presence signal output by the vehicle presence detector.

9. The distributed control system as set forth in claim 7, further including at least one traffic light connected to the local controller, the local controller controlling the traffic light to be in one of a plurality of states in response to the traffic light receiving from the local controller a traffic light control signal related to the one state.

10. The distributed control system as set forth in claim 9, wherein:

the second communication signal includes traffic light control data corresponding to a desired state of the traffic light; and the local controller outputs to the traffic light as, a function of the traffic light control data, the traffic light control signal.

11. The distributed control system as set forth in claim 9, wherein the plurality of optical states of the traffic light include an on-state and an off-state of a lamp.

12. The distributed control system as set forth in claim 7, wherein:

each switch machine is connected to the local controller by a first cable;

the central office is connected to the local controller by a second cable; and the maximum length of any first cable is less than the maximum length of the second cable.

13. A method of controlling vehicles on a track network, the method comprising the steps of:

(a) providing a track network having a plurality of switch machines connected to a local controller;

(b) receiving at the local controller from the each of the switch machines a switch position signal related to a state of a track switch associated with the corresponding switch machine;

(c) converting at least one switch position signal received at the local controller into switch position data;

(d) conveying the switch position data from the local controller to a central office;

(e) receiving switch control data at the local controller from the central office as a function of the switch position data and a desired movement of vehicles on the track network;

(f) converting the switch control data received at the local controller into a switch control signal; and (g) conveying the switch control signal from the local controller to the at least one switch machine which sets the corresponding track switch to a state related to the switch control signal.

14. The method as set forth in claim 13, further including the steps of:

receiving at the local controller from a vehicle presence detector a vehicle presence signal related to the presence of a vehicle on the track network;

converting the vehicle presence signal received at the local controller into vehicle presence data; and conveying the vehicle presence data from the local controller to the central office, wherein the switch control data received at the local controller from the central office is also a function of the vehicle presence data.

15. The method as set forth in claim 13, further including the step of:

receiving traffic light control data at the local controller from the central office as a function of the switch position data and a desired movement of vehicles on the track network, the traffic light control data corresponding to a desired state of a traffic light connected to the local controller;

converting the traffic light control data received at the local controller into a traffic light control signal; and conveying the traffic light control signal from the local controller to the traffic light whereby the traffic light is set in one of a plurality of optical states.

16. An apparatus for controlling vehicles on a track network, the apparatus comprising:

a central office configured to control the movement of vehicles on a track network;

a plurality of switch machines, each switch machine configured to output a switch position signal indicative of a state of a track switch associated with the switch machine in a one of a plurality of positions and to control the state of the track switch in response to receiving a switch control signal; and a local controller configured for receiving from the plurality of switch machines the switch position signals related to the state of the track switches controlled by the plurality of switch machines, for converting the switch position signals into switch position data, for conveying the switch position data to the central office, for receiving switch control data from the central office as a function of the conveyed switch position data and a desired movement of vehicles on the track network, for converting the received switch control data into switch control signals, and for conveying each switch control signal to one of the switch machines whereby the corresponding track switch is set to a state related to the switch control signal received by the one of the switch machines.

17. The apparatus as set forth in claim 16, further including a traffic light connected to the local controller, wherein the local controller receives traffic light control data from the central office as a function of the switch position data and a desired movement of vehicles on the track network, converts the received traffic light control data into a traffic light control signal, and conveys the traffic light control signal to the traffic light whereby the traffic light is set in one of a plurality of optical states as a function of the traffic light control signal.

18. The apparatus as set forth in claim 16, further including a vehicle presence detector configured to output to the local controller a vehicle presence signal as a function the presence of a vehicle on the track network, wherein:

the local controller converts the received vehicle presence signal into vehicle presence data and conveys the vehicle presence data to the central office; and the switch control data received by the local controller is also a function of the conveyed vehicle presence data.

19. The apparatus as set forth in claim 17, further including a traffic light connected to the local controller, wherein the local controller receives traffic light control data from the central office as a function of the vehicle presence data, the switch position data and a desired movement of vehicles on the track network, converts the received traffic light control data into a traffic light control signal, and conveys the traffic light control signal to the traffic light whereby the traffic light is set in one of a plurality of optical states as a function of the traffic light control signal.

* * * * *